US006227235B1

(12) United States Patent
Laing et al.

(10) Patent No.: US 6,227,235 B1
(45) Date of Patent: May 8, 2001

(54) TEMPERATURE REGULATED HOT WATER RECIRCULATION SYSTEM

(76) Inventors: Johannes Nikolaus Laing, 1253 La Jolla Rancho Rd., La Jolla, CA (US) 92037; Birger Johannes Laing, Kirchenweinbergstrasse 45, 71672 Marbach (DE)

( * ) Notice: Subject to any disclaimer, the term of this patent is extended or adjusted under 35 U.S.C. 154(b) by 0 days.

(21) Appl. No.: 09/630,193

(22) Filed: Aug. 1, 2000

Related U.S. Application Data

(63) Continuation-in-part of application No. 09/307,852, filed on May 10, 1999, which is a continuation-in-part of application No. 09/020,349, filed on Feb. 9, 1998, now Pat. No. 5,983,922, which is a continuation-in-part of application No. 08/669,147, filed on Jun. 24, 1996, now Pat. No. 5,941,275.

(51) Int. Cl.[7] ..... F24H 1/00

(52) U.S. Cl. ..... 137/337; 236/12.16; 236/12.17; 417/12

(58) Field of Search ..... 236/12.11, 12.12, 236/12.16, 12.17; 137/337; 417/12, 32

(56) References Cited

U.S. PATENT DOCUMENTS

| | | | | |
|---|---|---|---|---|
| 2,247,227 | * | 6/1941 | Findley | 251/208 |
| 3,090,559 | * | 5/1963 | Bayer | 236/12.16 |
| 3,397,841 | * | 8/1968 | Kieslich | 236/12.17 |
| 3,741,195 | * | 6/1973 | Ellis | 126/362 |
| 3,987,819 | * | 10/1976 | Scheuermann | 137/637.3 |
| 5,105,846 | * | 4/1992 | Britt | 137/337 |
| 5,603,344 | * | 2/1997 | Hall, Jr. | 137/2 |

* cited by examiner

*Primary Examiner*—A. Michael Chambers

(57) ABSTRACT

In a hot and cold water distribution system, cooled down water in the hot water distribution line is automatically drained toward the cold water distribution line by a connection system consisting essentially of a centrifugal pump in series with a valve oriented to prevent the flow of cold water into the hot water distribution line or of hot water into the cold water distribution line by the same valve.

3 Claims, 2 Drawing Sheets

TEMPERATURE REGULATED HOT WATER RECIRCULATION SYSTEM

PRIOR APPLICATION

This is a continuation-in-part of co-pending application Ser. No. 09/307,852 filed May 10, 1999 a continuation-in-part of application 09/020,349, filed Feb. 9, 1998, now U.S. Pat. No. 5,983,922 issued Nov. 16, 1999, a continuation-in-part of application Ser. No. 08/669,147, filed Jun. 24, 1996 now U.S. Pat No. 5,941,275 issued Aug. 24, 1999.

FIELD OF THE INVENTION

The invention related to hot water distribution system, and more specifically to recirculation pumps for assuring instantaneous hot water delivery from a hot water tap.

BACKGROUND OF THE INVENTION

Hot water recirculating systems are known in which the cooled down water content of the hot water distribution line is conveyed back into the hot water tank via a recirculation pipe as disclosed in the earlier U.S. Pat. No. 5,143,049. Modifying an existing water distribution system requires the installation of additional piping, which may be difficult to install. A different hot water recovery system is disclosed in U.S. Pat. No. 5,009,572 Imhoff et al. and U.S. Pat. No. 5,143,049 Laing, in which a recirculation pump is switched on if the hot water temperature near the faucet drops below a pre-determined level or as soon as a hot water faucet is opened. U.S. Pat. No. 5,277,219, Lund discloses a recirculation system in which the pump is activated by temperature sensors positioned near each hot water faucet. The pump conveys the cooled-down content of the hot water distribution line through the cold water distribution line back into the water heater. Thus the faucets in the distribution line receive warm water from the water heater when the cooled-down water content between the water heater and the faucets has been pumped into the cold water distribution line.

The aforesaid U.S. Pat. Nos. 5,009,572 Imhoff et al.; 5,143,049 Laing et al.; and 5,277,219 Lund are incorporated into this specification by this reference.

The prior art systems that recirculate the cooled-down portion of the hot water distribution line directly through the cold water distribution line have several drawback. The most serious is the fact that the system of Lund does not provide instant hot water because the pump does not start before the hot water faucet is turned on, so that hot water is only available when the hot water from the water heater has reached the faucet and has risen to the desired temperature. Indeed, the first volume of water coming from the hot water heater is cooled down by the cold water pipe, and a considerable amount of water must be drawn through the hot water faucet before that desired temperature is reach. A further disadvantage lies in the use of solenoids because they are expensive and prone to failure by lime deposits.

The present invention avoids these drawback.

SUMMARY OF THE INVENTION

The primary object of the invention is to improve the operation of a hot and cold water distribution system by simplifying the recirculation circuit; assuring an immediate supply of hot water to a hot water faucet by draining any cooled down water in the hot water distribution line into the cold water distribution line for recirculation into the water heater. Aim of the invention is to prevent the drawing of warm water that has purged from the hot water distribution line when a cold water faucet is turned on; and to prevent that cold water will be conveyed into the hot water distribution line when a hot water faucet is turned on, whereby in both cases a pressure drop is caused in the water distribution line by the friction within the line; and to do this with a minimum number of simple, inexpensive and reliable components, and system installation time.

These and other valuable objects are achieved by means of a recirculation circuit that in its simplest form consists essentially of a pump, a valve mounted in series between the most distal point of the hot water distribution line and the cold water distribution line and a temperature sensor. The pump is activated whenever the temperature sensor positioned at the most distal of the hot water distribution line senses that the temperature of the hot water distribution line has fallen below a present level. The valve will prevent flow of cold water into the hot water distribution line when a hot water faucet is turned on, and will prevent hot water from flowing into the cold water distribution line when a cold water faucet it turned on. Each time a faucet is opened, the pressure in that line goes down, caused by the friction within the relevant line.

DESCRIPTION OF THE PREFERRED EMBODIMENT OF THE INVENTION

Figure 1:
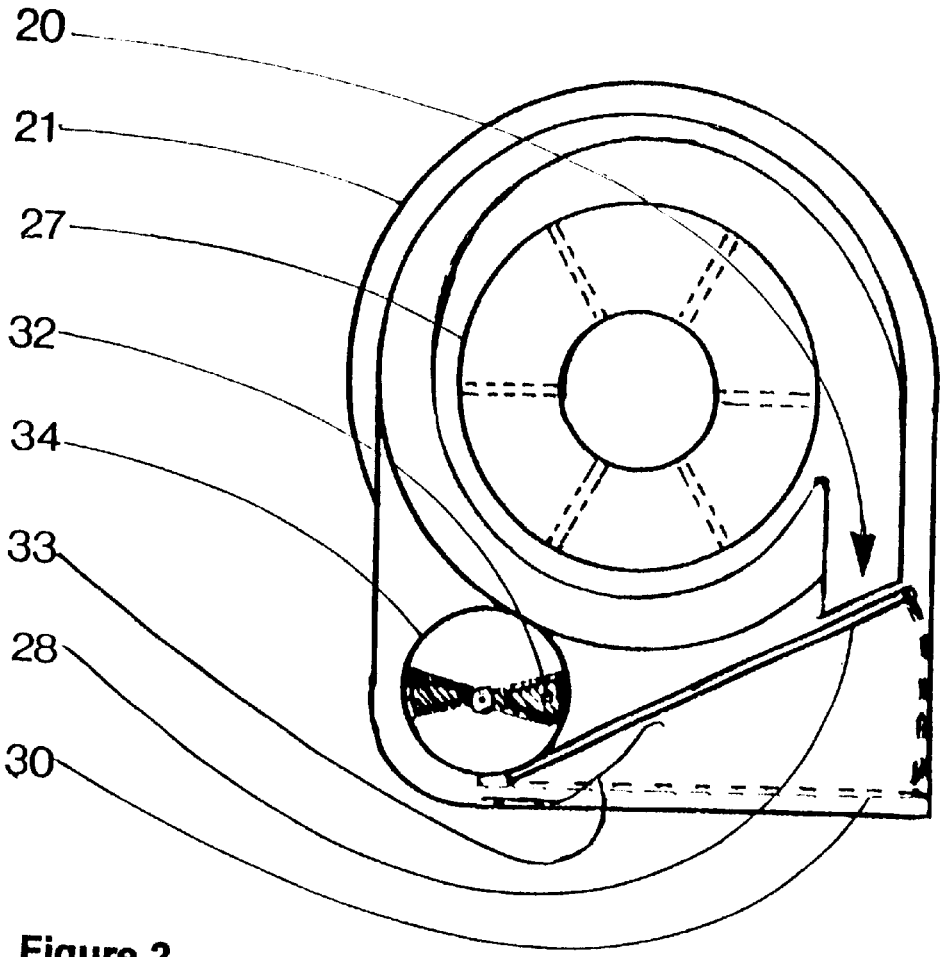
FIG. 1 shows a system with a circular pump and a bimetal helix.

FIG. 1 shows the diagram of a domestic hot and cold water distribution system with a hot water supply line 4 that draws hot water from the hot water heat 1, and a cold water distribution line 7 that is connected with the main and the dip tube 6, whereby a pump 12 is installed at the end of lines 4 and 7. This pump 12 conveys cooled down water from the hot water supply line 4 into the cold water distribution line 7. A thermo-switch 15, arranged close to the suction port of the pump 12 activates the pump for the time it takes to replace the cooled down water in the hot water supply line 4 with hot water.

If the hot water faucet 3 is opened all the way, the pressure in the hot water supply line 4 drops due to the flow resistance of line 4 while the pressure at the end of the cold water distribution line 7 is still unchanged. To prevent that hereby cold water would flow through pump 12 into the hot water distribution line 4, a valve 13, 14 is installed. If a cold water faucet 9 is opened and the pressure within the cold water distribution line 7 drops, the same valve 13, 14 prevents a flow from the hot water distribution line 4 into the cold water distribution line 7. Said valve 13, 14 is designed as a valve of the washerless type. The drop in the water temperature causes a bimetal-helix 11 to turn the rotatably mounted valved disc 13 so that its holes are aligned with the holes of disc 14 thereby opening the passage for the water conveyed by pump 12 to flow from point H to point C. The water flow is guided into the cold water line 7 and from there back to the water heater 1. As soon as the new filling of hot water in line 4 reaches the thermal sensor 15, pump 12 stops and the bimetal helix 11, due to the increase in water temperature, returns valve disc 13 into its previous closed position. If the temperature falls substantially under the temperature of the cooled down water content of the water in line 4, (which will be the case when the recirculating system is turned off) the bimetal-helix rotates the rotatable disc 13 into a third position relative to the stationary disc 14 in which the valve is also closed as in the situation where the hot water line 4 in filled with hot water.

Figure 2:
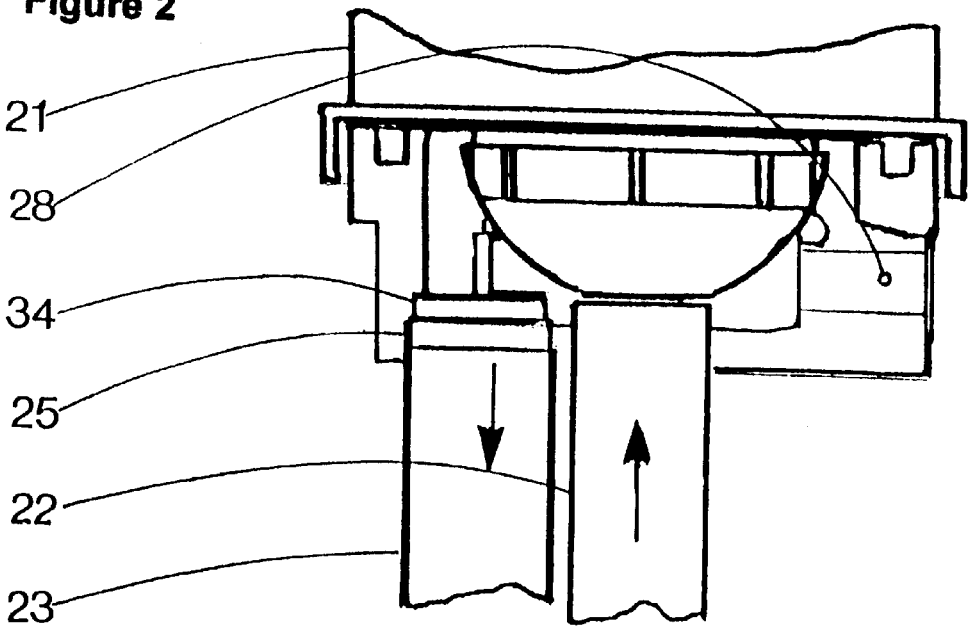
FIG. 2 shows a circular pump with a valve activated by a jet produced by said pump.
Figure 3:
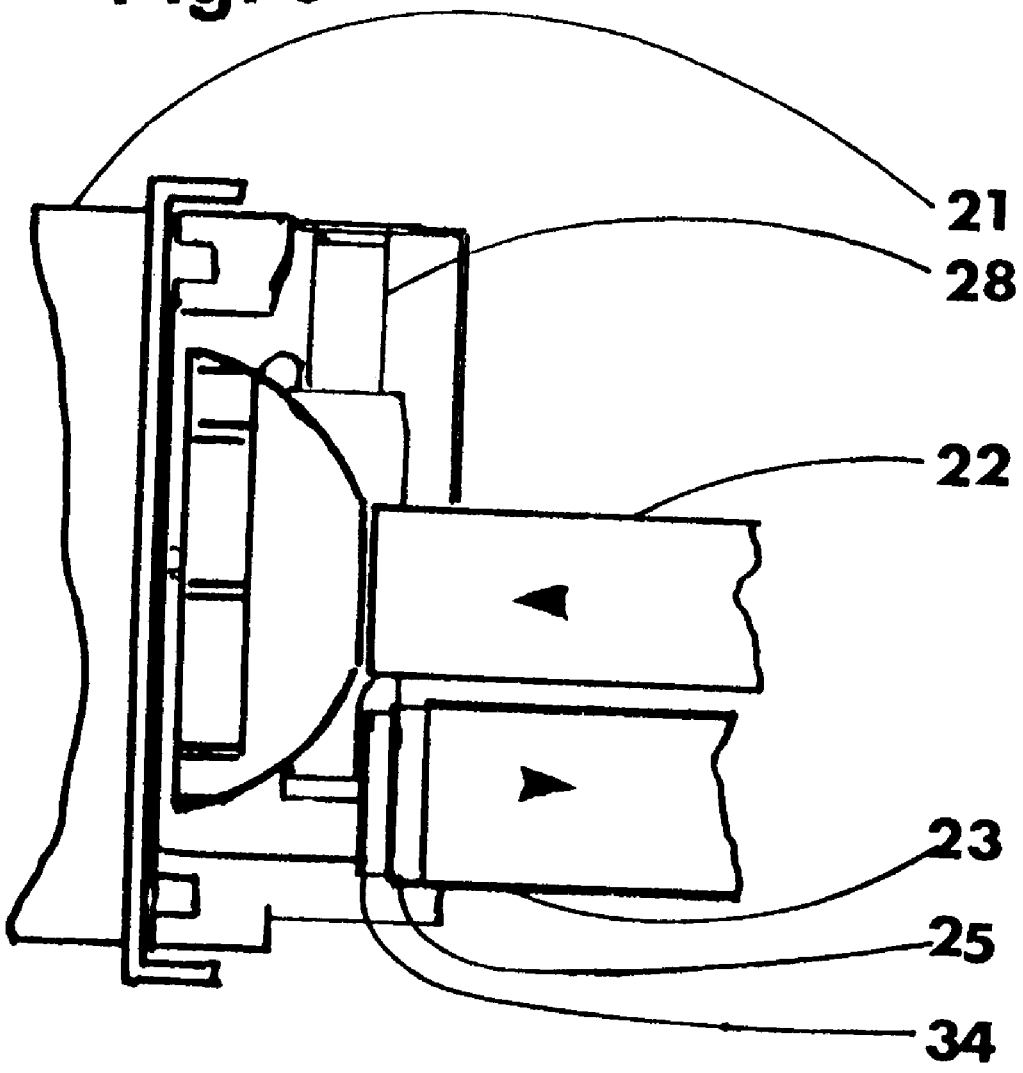
FIG. 3 shows the arrangement of FIG. 2 in a cross section parallel to the axis of rotation of the pump.

In the circuit with a more complex recirculation pump and a valve illustrated in FIG. 2 and FIG. 3, a jet-forming nozzle 20 is located at the pressure side 26 of the spiral housing of the pump 21. An inlet 22 is connected to point H of the hot water line 4. The outlet 23 comprises a disc valve 34, 25 that prevents flow from the cold water distribution line 7 to the hot water distribution line 4, if a hot water faucet 3 is opened, and prevents flow from the hot water line 4 to the cold water line 7 if a cold water faucet is opened. The pump 21 with impeller 27 is activated by a temperature sensor 15. Nozzle 20 forms a jet, which pushes the level 28 into position 30 shown by the dotted line. That level 28 forms a part with the movable disc 34. In the position shown the valve 34, 25 interrupts any flow between H and C, however, if the pump is activated and the level 28 is pushed into position 30, the holes 32 in the rotatably mounted disc 34 are aligned with the holes (not shown) in the stationary disc 25. The cooled down warm water of the hot water distribution line 4 now can be conveyed through lines 23, 7 and 5 back to the water heater 1. A spring 33 moves the lever 28 back into its first position as soon as the pump is switched off, closing the passage between H and C.

Many different designs with a washerless valve are conceivable. The pumps shown in FIGS. 1 and 2 are typical examples for the realization of the invention.

What is claimed is:

1. A hot and cold water distribution system wherein potable hot water is distally delivered through a hot water distribution line from a water heater to a hot water faucet, and cold water is delivered through a cold water distribution line to said water heater and to a cold water faucet proximate to said hot water faucet, said system comprising a pump installed proximate said faucets to draw water cooled down in said hot water distribution line into said cold water distribution line, an improvement for preventing flow from the hot water distribution line into the cold water distribution line as well as from the cold water distribution line into the hot water distribution line when the pump is not in operation by a disc valve comprising a stationary disc with holes, and a rotatably mounted disc with holes of similar configuration and cross-section, and areas which close the holes of the stationary disc in a first angular position and hydraulic means which align the holes of both discs in a second angular position when the pump is in operation.

2. A hot and cold water distribution system according to claim 1, whereby the running pump generates a drag force which rotates a rotatably mounted disc from its first closed position into its second open position.

3. A hot and cold water distribution system according to claim 2, whereby the running pump generates a water jet which is directed onto a lever being connected to the rotatably mounted disc which lever rotates said disc into its second open position when the pump starts running.

* * * * *